US012031297B2

(12) United States Patent
Sasaki et al.

(10) Patent No.: US 12,031,297 B2
(45) Date of Patent: Jul. 9, 2024

(54) WORK MACHINE

(71) Applicant: KOBELCO CONSTRUCTION MACHINERY CO., LTD., Hiroshima (JP)

(72) Inventors: Hitoshi Sasaki, Hiroshima (JP); Seiji Saiki, Hiroshima (JP); Yoichiro Yamazaki, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 381 days.

(21) Appl. No.: 17/435,195

(22) PCT Filed: Nov. 25, 2019

(86) PCT No.: PCT/JP2019/045982
§ 371 (c)(1),
(2) Date: Aug. 31, 2021

(87) PCT Pub. No.: WO2020/188891
PCT Pub. Date: Sep. 24, 2020

(65) Prior Publication Data

US 2022/0145588 A1 May 12, 2022

(30) Foreign Application Priority Data

Mar. 20, 2019 (JP) ..... 2019-053621

(51) Int. Cl.
*E02F 9/20* (2006.01)

(52) U.S. Cl.
CPC ..... *E02F 9/2012* (2013.01); *E02F 9/205* (2013.01)

(58) Field of Classification Search
CPC ..... E02F 9/2012; E02F 9/2004; E02F 9/16
See application file for complete search history.

(56) References Cited

U.S. PATENT DOCUMENTS 6,450,284 B1 9/2002 Sakyo et al.

FOREIGN PATENT DOCUMENTS

| | | |
|---|---|---|
| JP | H08-249080 A | 9/1996 |
| JP | H11-61887 A | 3/1999 |
| JP | 2017-172174 A | 9/2017 |

OTHER PUBLICATIONS

WIPO English translation of JP 2017172174 (Year: 2017).*
Extended European Search Report dated Feb. 9, 2022 issued in corresponding European patent application No. 19920285.4.

* cited by examiner

*Primary Examiner* — Jason Holloway
*Assistant Examiner* — Christopher A Buksa
(74) *Attorney, Agent, or Firm* — Carrier, Shende & Associates P.C.; Joseph P. Carrier; Jeffrey T. Gedeon

(57) ABSTRACT

A first operating mechanism 7 of a work machine 1 includes a first guide member 74 which tilts a fourth operating lever 5 in the right-left direction, and a first actuator 72 which generates a driving force for tilting a first direction guide member 74 on the basis of an operation command. The first actuator 72 is disposed at a position on the opposite side of the fourth operating lever 5 from a slave-side seat 3.

5 Claims, 7 Drawing Sheets

WORK MACHINE

TECHNICAL FIELD

The present invention relates to a work machine which is operated on the basis of an operation command, and particularly, to a work machine which is remotely operated.

BACKGROUND ART

A conventionally-known operating mechanism remotely operates a work machine by indirectly operating, on the basis of an operation command transmitted from the outside of the work machine, an operating lever which can be directly operated by an operator sitting in a seat (e.g., refer to Patent Literature 1). An operating mechanism described in Patent Literature 1 includes, to tilt an operating lever, an actuator which operates on the basis of an operation command and a guide member which tilts the operating lever using a driving force of the actuator.

CITATION LIST

Patent Literature

Patent Literature 1: Japanese Patent Laid-Open No. 2017-172174

SUMMARY OF INVENTION

Technical Problem

As described in Patent Literature 1, in a typical work machine, a console box is disposed beside a seat in which an operator sits, and an operating lever is disposed on the upper face of the console box.

If an operating mechanism for remotely operating the operating lever is attached to such a work machine, the operating mechanism may occupy a space for an operator to sit in (that is, a space on the seat). In such a case, the operating mechanism may obstruct movement of the operator, which may make it difficult for the operator sitting in the seat to directly operate the operating lever.

The present invention has been made in view of the above problem, and an object thereof is to provide a work machine which can be remotely operated and can leave a sufficient space on a seat.

Solution to Problem

A work machine of the present invention is a work machine operated on the basis of an operation command, the work machine comprising:

a seat for an operator to sit in;

an operating lever for controlling an operating amount of the work machine according to a tilt angle and a tilt direction, the operating lever being disposed beside the seat; and an operating mechanism configured to tilt the operating lever on the basis of the operation command, in which the operating mechanism includes a first direction guide member configured to tilt the operating lever in a first direction, and a first direction actuator configured to generate a driving force for tilting the operating lever through the first direction guide member on the basis of the operation command, and the first direction actuator is disposed at a position on the opposite side of the operating lever from the seat.

DESCRIPTION OF EMBODIMENT

Hereinbelow, a remote operation system S according to an embodiment will be described with reference to the drawings.

First, the configuration of the remote operation system S will be described with reference to FIGS. 1 to 3.

Figure 1:
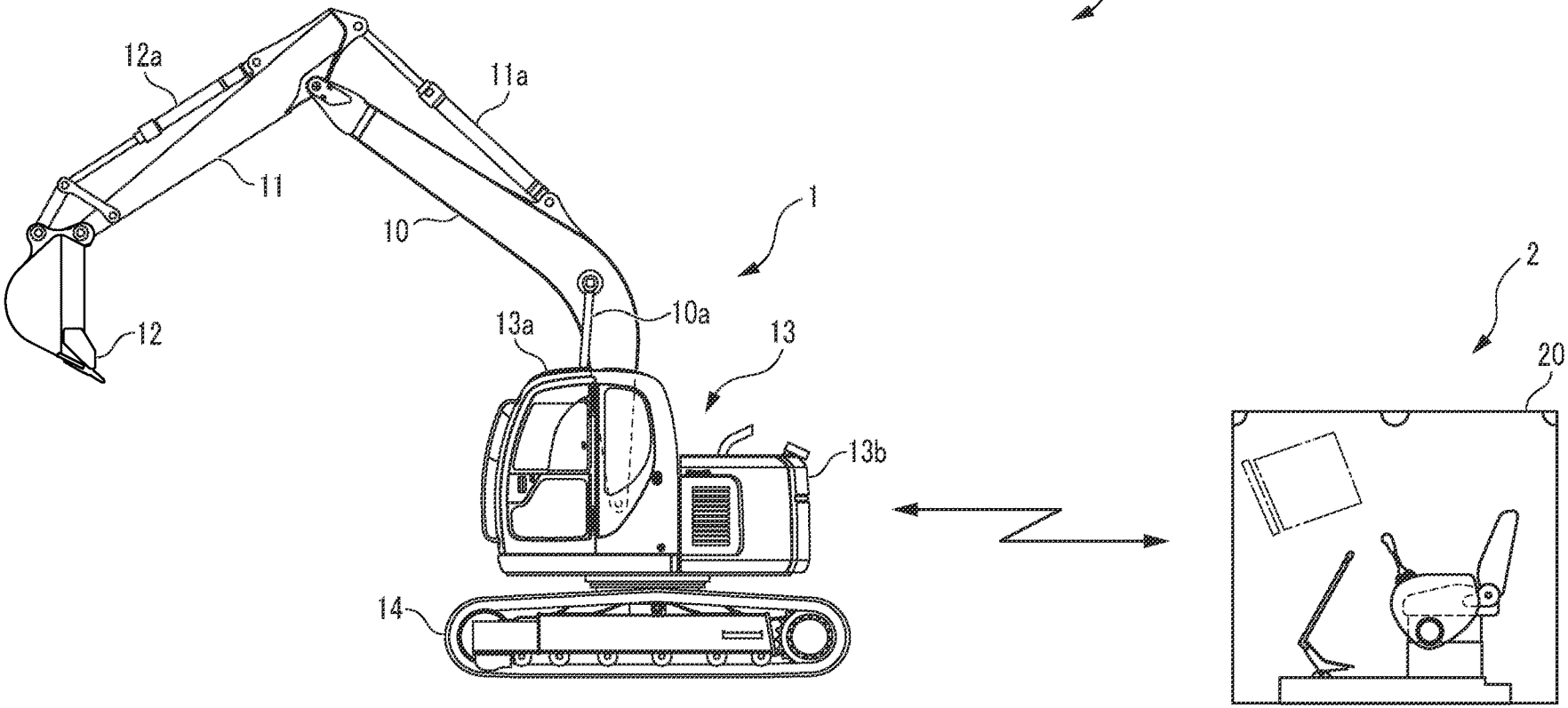
FIG. 1 is a schematic diagram illustrating the entire configuration of a remote operation system of a work machine according to an embodiment.

As illustrated in FIG. 1, the remote operation system S comprises a work machine 1 which is a hydraulic excavator and a remote operation apparatus 2 for remotely operating the work machine 1. The work machine 1 can be directly operated by an operator on board or can be indirectly operated through the remote operation apparatus 2 with no operator on board.

Note that, in the present embodiment, the hydraulic excavator is used as the work machine. However, the work machine of the present invention is not limited to the hydraulic excavator. For example, the work machine may also be a crane truck or a dump truck.

The work machine 1 comprises work equipment including a boom 10, an arm 11, and an attachment 12, a slewing structure 13 on which the work equipment is mounted, and an undercarriage 14 which slewably supports the slewing structure 13.

A proximal end portion of the boom 10 is swingably attached to a front portion of the slewing structure 13. The boom 10 includes a first hydraulic cylinder 10*a* having an end attached to the boom 10 and an end attached to the slewing structure 13. The boom 10 is swung relative to the slewing structure 13 through extension and contraction of the first hydraulic cylinder 10*a*.

A proximal end portion of the arm 11 is swingably attached to a distal end portion of the boom 10. The arm 11 includes a second hydraulic cylinder 11*a* having an end attached to the arm 11 and an end attached to the boom 10. The arm 11 is swung relative to the boom 10 through extension and contraction of the second hydraulic cylinder 11*a*.

The attachment 12 is swingably attached to a distal end portion of the arm 11. The attachment 12 includes a third hydraulic cylinder 12*a* having an end attached to the attachment 12 and an end attached to the arm 11. The attachment 12 is swung relative to the arm 11 through extension and contraction of the third hydraulic cylinder 12*a*.

Note that, in the present embodiment, a bucket is used as the attachment 12. However, the attachment 12 is not limited to the bucket and may be another kind of attachment (e.g., a crusher, a breaker, or a magnet).

The slewing structure 13 is slewable around a yaw axis relative to the undercarriage 14 through a slewing hydraulic motor (not illustrated). A cab 13*a* for an operator to get in is provided in a front portion of the slewing structure 13, whereas a machine room 13*b* is provided in a rear portion of the slewing structure 13.

A slave-side operating device 15 (refer to FIG. 2) for operating the work machine 1 is disposed in the cab 13*a*. The slave-side operating device 15 includes, for example, an operating pedal, an operating switch, and a fourth operating lever 5 and a fifth operating lever 6 (refer to FIG. 4), which will be described later.

Hydraulic devices (not illustrated) such as a hydraulic pump, a direction selector valve, and a hydraulic oil tank, and an engine (not illustrated) as a power source of the hydraulic pump and the like are stored in the machine room 13*b*.

The undercarriage 14 is a crawler type undercarriage and driven by a traveling hydraulic motor (not illustrated). Note that the undercarriage of the work machine of the present invention is not limited to a crawler. For example, the undercarriage may move with wheels or legs. Further, in a case where the work machine is used on the water, the undercarriage may be, for example, a barge.

Note that the work machine 1 may further include an actuator (e.g., a hydraulic actuator for driving a dozer or a hydraulic actuator included in an attachment such as a crusher) in addition to the traveling hydraulic motor, the slewing hydraulic motor, the first hydraulic cylinder 10*a*, the second hydraulic cylinder 11*a*, and the third hydraulic cylinder 12*a* described above. Further, some of the actuators of the work machine 1 (e.g., the slewing actuator) may be electric actuators.

In operating the work machine 1, each of the actuators including the traveling hydraulic motor, the slewing hydraulic motor, the first hydraulic cylinder 10*a*, the second hydraulic cylinder 11*a*, and the third hydraulic cylinder 12*a* is activated by operating the slave-side operating device 15 with the engine running. For example, the activation of each actuator in response to the operation of the slave-side operating device 15 can be performed in a manner similar to that of a known work machine.

Figure 2:
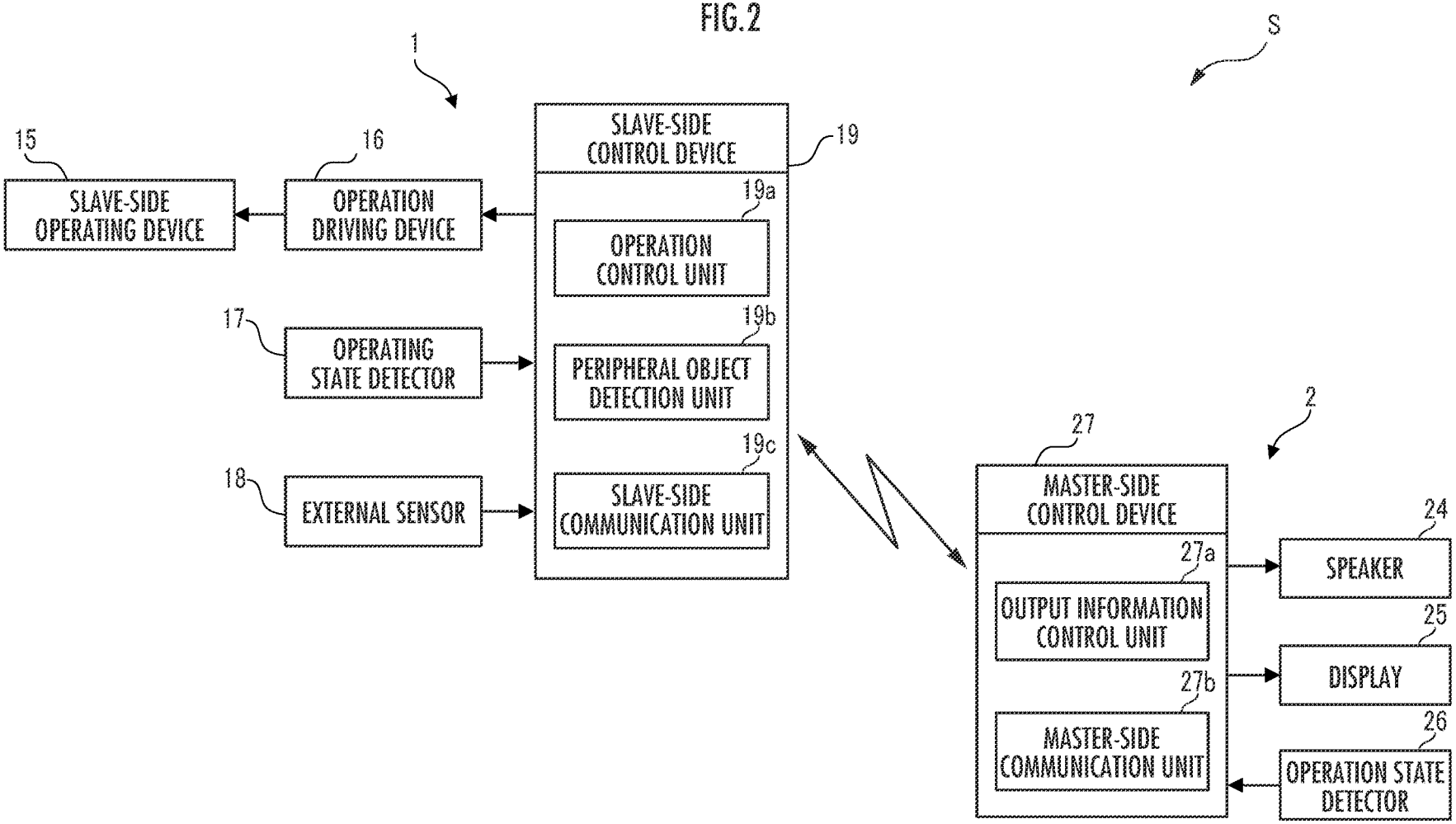
FIG. 2 is a schematic diagram illustrating the schematic configuration of a remote operation apparatus of the remote operation system of FIG. 1.

As illustrated in FIG. 2, the work machine 1 comprises, in the cab 13*a*, an electric operation driving device 16 (e.g., a first operating mechanism 7 and a second operating mechanism 8 (refer to FIG. 4), which will be described later) which drives the slave-side operating device 15 to enable remote operation.

The operation driving device 16 is connected to the slave-side operating device 15. Note that the operation driving device 16 may be detachable from the work machine 1.

The operation driving device 16 includes a plurality of electric motors (not illustrated). The operation driving device 16 drives each of the operating pedal, the operating switch, and the fourth operating lever 5 and the fifth operating lever 6 (refer to FIG. 4), described later, which are included in the slave-side operating device 15, using a driving force from the electric motors.

The work machine 1 further comprises an operating state detector 17 for detecting the operating state of the work machine 1, an external sensor 18 which is, for example, a camera which detects a state around the work machine 1, and a slave-side control device 19 capable of executing various control processes.

The operating state detector 17 is, for example, a detector which detects the rotation angle of the swing operation of each of the boom 10, the arm 11, and the attachment 12 or the stroke length of the first hydraulic cylinder 10*a*, the second hydraulic cylinder 11*a*, and the third hydraulic cylinder 12*a*, a detector which detects the slewing angle of the slewing structure 13, a detector which detects the driving speed of the undercarriage 14, a detector which detects the tilt angle of the slewing structure 13 or the undercarriage 14, or an inertial sensor which detects the angular velocity or acceleration of the slewing structure 13.

The external sensor 18 includes, for example, a camera, a range sensor, or a radar. The cameras or the like constituting the external sensor 18 are installed at a plurality of locations on, for example, a peripheral portion of the slewing structure 13 so as to detect an object present around the slewing structure 13.

The slave-side control device 19 includes, for example, one or more electronic circuit units including a microcomputer, a memory, an interface circuit, and the like. The slave-side control device 19 appropriately acquires a detection signal of the operating state detector 17 and a detection signal of the external sensor 18.

The slave-side control device 19 has, as functions implemented by both or one of hardware configurations mounted thereon and a program (software configuration), a function as an operation control unit 19*a*, a function as a peripheral object detection unit 19*b*, and a function as a slave-side communication unit 19*c*.

The operation control unit 19*a* controls the operation of the work machine 1 by controlling the activation of the operation driving device 16 (in turn, controlling the operation of the slave-side operating device 15) and controlling the operation of the engine in response to the operation of the slave-side operating device 15 or an operation command transmitted from the remote operation apparatus 2.

The peripheral object detection unit 19*b* detects, on the basis of a detection signal of the external sensor 18, an object such as a person or an installed object which may be present in a predetermined target space around the work machine 1.

The slave-side communication unit 19*c* appropriately performs wireless communication with the remote operation apparatus 2 via a master-side communication unit 27*b*, which will be described later.

Figure 3:
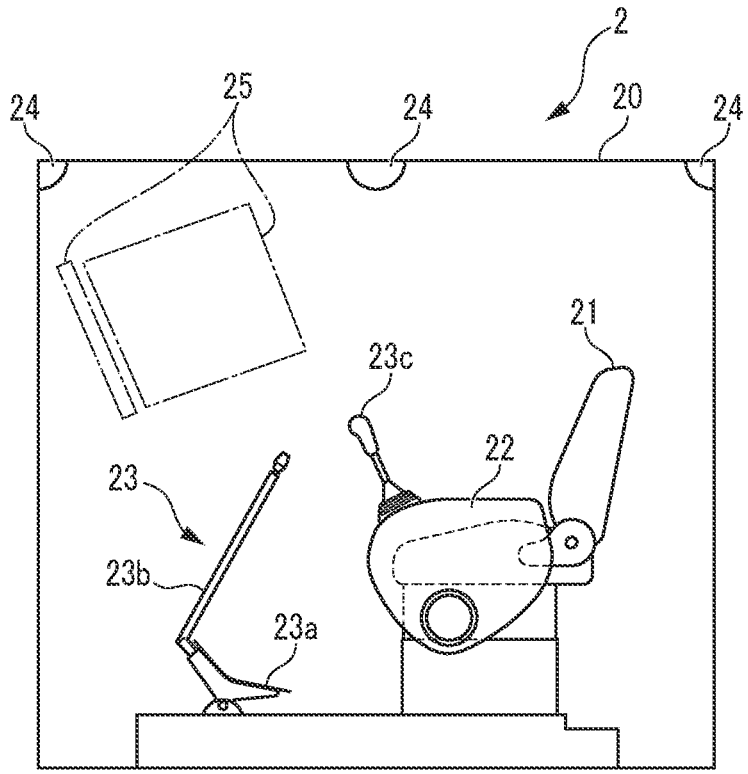
FIG. 3 is a block diagram illustrating a configuration relating to control of the remote operation system of FIG. 1.

As illustrated in FIG. 3, the remote operation apparatus 2 comprises, inside a remote operation room 20, a master-side seat 21 in which an operator sits, a pair of right and left master-side console boxes 22 which are disposed on right and left sides of the master-side seat 21, a master-side operating device 23 which is operated by the operator to remotely operate the work machine 1, a speaker 24 serving as an output device for outputting acoustic information (auditory information), and a display 25 serving as an output device for outputting display information (visual information).

As illustrated in FIG. 2, the remote operation apparatus 2 further comprises an operation state detector 26 for detecting the operation state of the master-side operating device 23 and a master-side control device 27 capable of executing various control processes. Note that the master-side control device 27 may be disposed either inside or outside the remote operation room 20.

The master-side operating device 23 is, for example, configured to be the same as or similar to the slave-side operating device 15 of the work machine 1.

Specifically, the master-side operating device 23 includes, for example, a first operating lever 23*b* with an operating pedal 23*a* which is installed at the front of the master-side seat 21, and a second operating lever (not illustrated) and a third operating lever 23*c* which are respectively mounted on the pair of right and left master-side console boxes 22 so that an operator sitting in the master-side seat 21 can operate the master-side operating device 23.

However, the master-side operating device 23 may be configured to be different from the slave-side operating device 15 of the work machine 1. For example, the master-side operating device 23 may be a portable operating device including, for example, a joystick or an operation button.

The operation state detector 26 is, for example, a potentiometer or a contact switch incorporated in the master-side operating device 23. The operation state detector 26 is configured to output a detection signal indicating the operation state of each operating unit (e.g., the operating pedal 23*a*, the first operating lever 23*b*, the second operating lever, or the third operating lever 23*c*) of the master-side operating device 23.

The speakers 24 are, for example, disposed at a plurality of locations inside the remote operation room 20, such as the front part, the rear part, and both the right and left sides of the remote operation room 20.

The display 25 includes, for example, a liquid crystal display or a head-up display. The display 25 is disposed forward of the master-side seat 21 so that an operator sitting in the master-side seat 21 can visually recognize the display 25.

The master-side control device 27 includes, for example, one or more electronic circuit units including a microcomputer, a memory, an interface circuit, and the like. The master-side control device 27 appropriately acquires a detection signal of the operation state detector 26. The master-side control device 27 recognizes, on the basis of the detection signal, an operation command to the work machine 1, the operation command being determined by the operation state of the master-side operating device 23.

The master-side control device 27 has, as functions implemented by both or one of hardware configurations mounted thereon and a program (software configuration), a function as an output information control unit 27*a* and a function as a master-side communication unit 27*b*.

The output information control unit 27*a* controls the speaker 24 and the display 25.

The master-side communication unit 27*b* appropriately performs wireless communication with the work machine 1 via the slave-side communication unit 19*c*. The master-side control device 27 transmits, to the slave-side control device 19, an operation command to the work machine 1 and receives, from the slave-side control device 19, various pieces of information of the work machine 1 (e.g., an image captured by the camera, detection information about an object around the work machine, and detection information about the operating state of the work machine 1) through the wireless communication.

Next, the configuration of the first operating mechanism 7 and the second operating mechanism 8 which are part of the operation driving device 16 will be described with reference to FIGS. 4 to 7.

Figure 4:
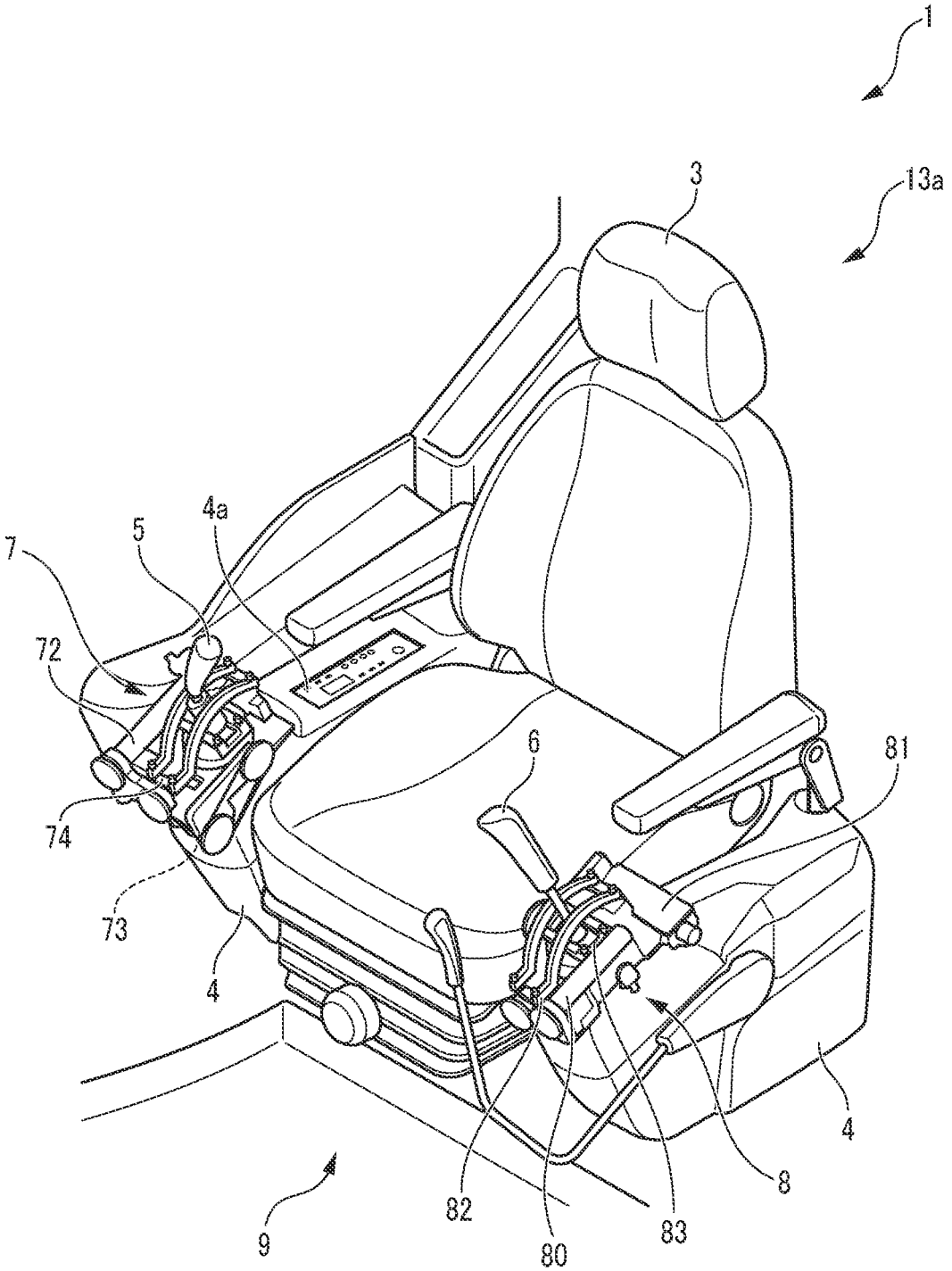
FIG. 4 is a perspective view illustrating the configuration of a seat and its surroundings in the work machine of FIG. 1.

As illustrated in FIG. 4, the work machine 1 comprises, inside the cab 13*a*, a slave-side seat 3 in which an operator sits and a pair of right and left slave-side console boxes 4 which are disposed on right and left sides of the slave-side seat 3.

The work machine 1 further comprises the slave-side operating device 15 (refer to FIG. 2). The slave-side operating device 15 includes, for example, the fourth operating lever 5 and the fifth operating lever 6 which are provided on the respective slave-side console boxes 4, and an operating pedal.

The work machine 1 further comprises the operation driving device 16 (refer to FIG. 2). The operation driving device 16 includes, for example, the first operating mechanism 7 (the operating mechanism for a work machine) for operating the fourth operating lever 5 and the second operating mechanism 8 (the operating mechanism for a work machine) for operating the fifth operating lever 6.

Further, inside the cab 13*a*, a getting-in/out passage 9 is formed forward of the slave-side seat 3 and the fifth operating lever 6. An operator passes through the getting-in/out passage 9 when sitting in the slave-side seat 3.

The fourth operating lever 5 and the fifth operating lever 6 are disposed in the front end portions of the respective slave-side console boxes 4. Further, the first operating mechanism 7 and the second operating mechanism 8 are attached to the front end portions of the respective slave-side console boxes 4 so as to respectively surround a base end portion of the fourth operating lever 5 and a base end portion of the fifth operating lever 6.

Of the right and left slave-side console boxes 4, the slave-side console box 4 located on the right side of the sitting operator (the left side in FIG. 4) includes a control panel 4*a* which is provided at a position rearward of the fourth operating lever 5. An operating switch is disposed on the control panel 4*a*.

The fourth operating lever 5 and the fifth operating lever 6 transmit signals to the slave-side control device 19 (refer to FIG. 2) according to a tilt angle and a tilt direction. The slave-side control device 19 controls the operating amount of the work machine 1 (e.g., the swing angle of the boom 10 and the arm 11 in the present embodiment) on the basis of the signals.

The first operating mechanism 7 and the second operating mechanism 8 respectively tilt the fourth operating lever 5 and the fifth operating lever 6 on the basis of an operation command from the remote operation apparatus 2. Specifically, the first operating mechanism 7 tilts the fourth operating lever 5 according to a tilt of the second operating lever (not illustrated) of the remote operation apparatus 2. On the other hand, the second operating mechanism 8 tilts the fifth operating lever 6 according to a tilt of the third operating lever 23*c* (refer to FIG. 3) of the remote operation apparatus 2.

Hereinbelow, the first operating mechanism 7 and the second operating mechanism 8 serving as the operating mechanism for a work machine will be described in detail.

Figure 5:
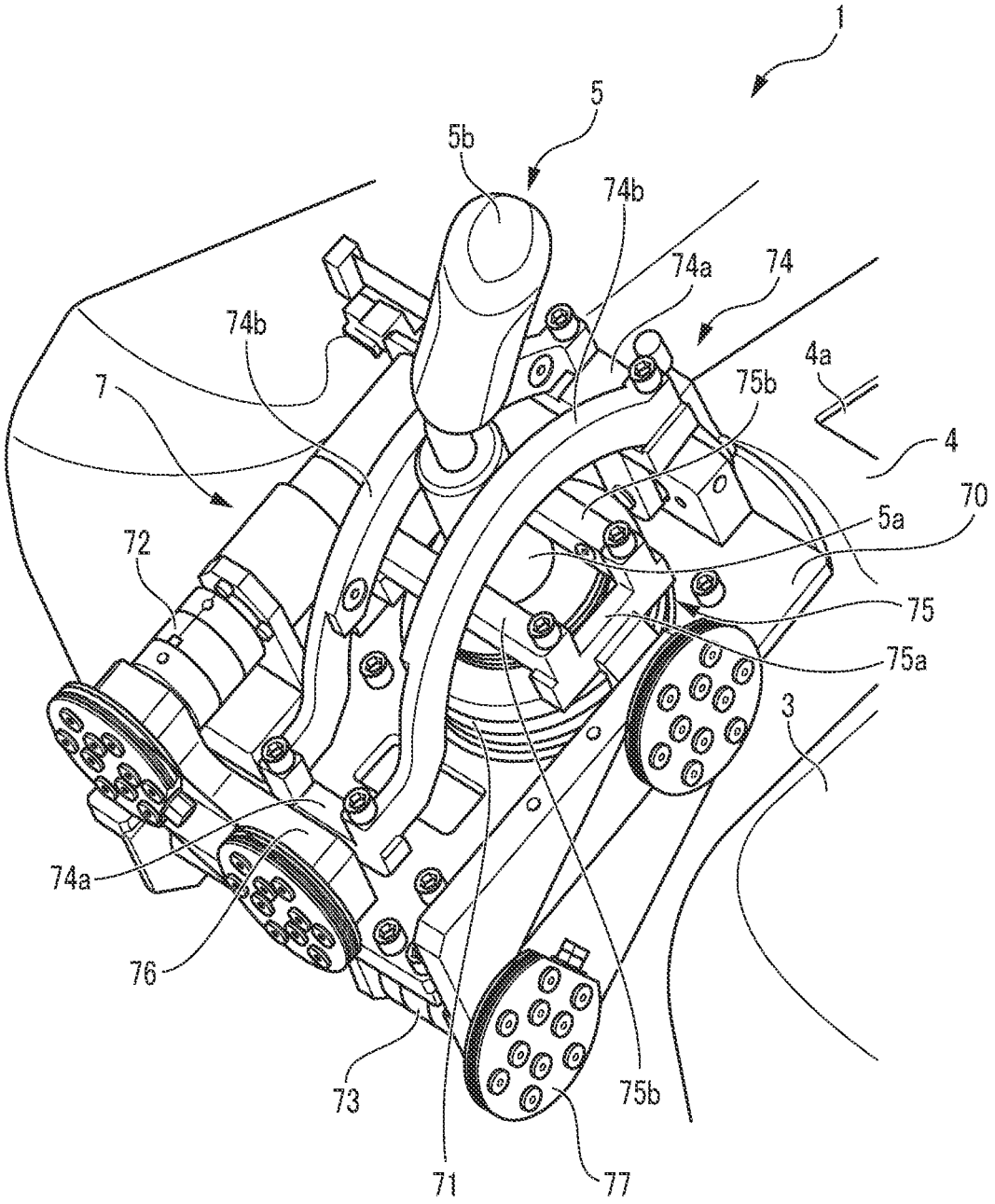
FIG. 5 is a perspective view of an operating mechanism of the work machine of FIG. 1.
Figure 6:
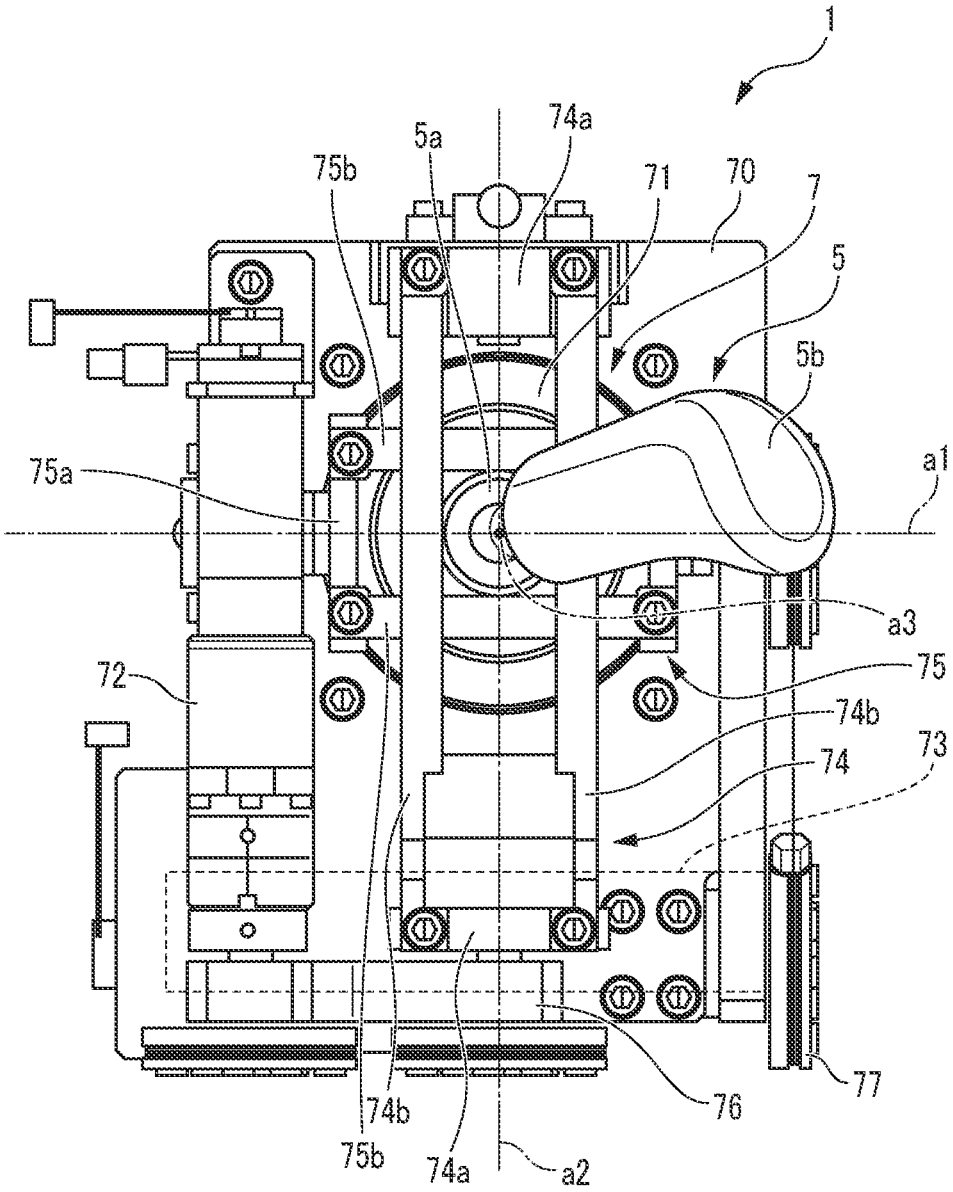
FIG. 6 is a plan view of the operating mechanism of the work machine of FIG. 1.

As illustrated in the perspective view of FIG. 5 and the plan view of FIG. 6, the first operating mechanism 7 comprises a plate 70 which is fixed to the slave-side console box 4 and a support member 71 which tiltably supports the fourth operating lever 5 about an axis in a central portion on the upper face side of the plate 70.

The plate 70 is a rectangular flat-shaped member. The plate 70 installed in the slave-side console box 4 is parallel to a reference plane p (refer to FIG. 7), which will be described later.

The support member 71 tiltably supports a base end portion 5*a* of the fourth operating lever 5 about an axis in the right-left direction as a first direction and the front-rear direction (the up-down direction in FIG. 6) as a second direction perpendicular to the first direction.

The first operating mechanism 7 further comprises a first actuator 72 (first direction actuator) which is disposed on the upper face side of the plate 70 (the front side in FIGS. 5 and 6) and a second actuator 73 (second direction actuator) which is disposed on the lower face side of the plate 70 (the back side in FIGS. 5 and 6).

The first actuator 72 and the second actuator 73 are electric actuators. The first actuator 72 generates a driving force turning around an axis extending in the up-down direction from a rotation axis (not illustrated) set on the lower end thereof. The second actuator 73 generates a driving force turning around an axis extending in the right-left direction from a rotation axis (not illustrated) set on the left end thereof.

The first operating mechanism 7 further comprises a first guide member 74 (first direction guide member) extending in the front-rear direction on the upper face side of the plate 70 and a second guide member 75 (second direction guide member) extending in the right-left direction on the upper face side of the plate 70 and below the first guide member 74.

The first guide member 74 includes a pair of front and rear first turning portions 74*a* and a pair of right and left first guide portions 74*b* which are arch-shaped members. The pair of first guide portions 74*b* extend in the front-rear direction with the base end portion 5*a* of the fourth operating lever 5 interposed therebetween. Ends of each of the first guide portions 74*b* are attached to the respective first turning portions 74*a*.

The first turning portions 74*a* are turnable around a second axis a2 extending in the second direction. When the first turning portions 74*a* turn, the first guide portions 74*b* also turn integrally with the first turning portions 74*a*. As a result, the first guide portions 74*b* press the base end portion 5*a* of the fourth operating lever 5 to tilt the fourth operating lever 5 in the right-left direction (first direction) along a first axis a1.

The second guide member 75 includes a pair of right and left second turning portions 75*a* and a pair of front and rear second guide portions 75*b* which are bar-shaped members. The pair of second guide portions 75*b* extend in the right-left direction with the base end portion 5*a* of the fourth operating lever 5 interposed therebetween. Ends of each of the second guide portions 75*b* are attached to the respective second turning portions 75*a*.

The second turning portions 75*a* are turnable around the first axis a1 extending in the first direction which is perpendicular to the second direction. When the second turning portions 75*a* turn, the second guide portions 75*b* also turn integrally with the second turning portions 75*a*. As a result, the second guide portions 75*b* press the base end portion 5*a* of the fourth operating lever 5 to tilt the fourth operating lever 5 in the up-down direction (second direction) along the second axis a2.

The second guide portions 75*b* of the second guide member 75 are located below the first guide portions 74*b* (the back side in FIGS. 5 and 6). However, the first guide portions 74*b* of the first guide member 74 are formed in an arch shape extending along the second axis, the arch shape being centered on the first axis a1. Thus, even when the second guide member 75 turns, the second guide portions 75*b* do not come into contact with the first guide portions 74*b*.

Note that, in the first operating mechanism 7, the first direction corresponds to the right-left direction, and the second direction corresponds to the front-rear direction. That is, the first direction and the second direction are perpendicular to each other. However, the first direction and the second direction of the present invention are not limited to directions perpendicular to each other and may be any directions intersecting each other. Thus, the first direction and the second direction may be appropriately determined according to a direction in which the operating mechanism tilts the operating lever.

Further, in the remote operation system S, the first guide member 74 and the second guide member 75 configured in this manner tilt the fourth operating lever 5. However, the guide member of the present invention is not limited to one comprising the first guide member 74 and the second guide member 75.

For example, in a case where the operating lever tilts in a reciprocating manner only in one direction, only one guide member may be provided. Further, the guide member may not be turned to press the operating lever, but extended and contracted to press the operating lever.

The first operating mechanism 7 further comprises a first link mechanism 76 which is disposed on the upper face side of the plate 70 and below the first actuator 72 and the first guide member 74, and a second link mechanism 77 which is disposed on the lower face side of the plate 70 and the opposite side of the second actuator 73 from the first actuator 72 (the right side in FIG. 6).

The first link mechanism 76 transmits the driving force from the first actuator 72, the driving force being generated on the basis of the operation command, to the first guide member 74. The second link mechanism 77 transmits the driving force from the second actuator 73, the driving force being generated on the basis of the operation command, to the second guide member 75.

As illustrated in FIG. 4, the second operating mechanism 8 basically has a configuration similar to that of the first operating mechanism 7.

However, the second operating mechanism 8 differs from the first operating mechanism 7 in that a third actuator 80 (first direction actuator) corresponding to the first actuator 72 of the first operating mechanism 7 is disposed on the right side, and a fourth actuator 81 (third direction actuator) corresponding to the second actuator 73 of the first operating mechanism 7 is disposed on the rear side.

Driving forces generated by the third actuator 80 and the fourth actuator 81 are transmitted to a third guide member 82 (first direction guide member) and a fourth guide member 83 (third direction guide member). The second operating mechanism 8 tilts the fifth operating lever 6 in the front-rear direction (the up-down direction in FIG. 6) and the right-left direction (the third direction) on the basis of an operation command using the driving forces as with the fourth operating lever 5.

In this manner, in the work machine 1, the first actuator 72 of the first operating mechanism 7 is disposed at the position on the opposite side of the fourth operating lever 5, which is operated by the first operating mechanism 7, from the slave-side seat 3. Further, the third actuator 80 of the second operating mechanism 8 is disposed at the position on the opposite side of the fifth operating lever 6, which is operated by the second operating mechanism 8, from the slave-side seat 3.

In other words, in the work machine 1, the first actuator 72 is disposed at the position more distant from the slave-side seat 3 than the fourth operating lever 5 is. Further, the third actuator 80 is disposed at the position more distant from the slave-side seat 3 than the fifth operating lever 6 is.

Thus, in the work machine 1, the first actuator 72 and the third actuator 80 do not project toward the slave-side seat 3 even in a state where the first operating mechanism 7 and the second operating mechanism 8 are respectively attached to the fourth operating lever 5 and the fifth operating lever 6, thereby making it possible to leave a sufficient space on the slave-side seat 3 for an operator to sit in.

Further, as described above, in the work machine 1, the second actuator 73 of the first operating mechanism 7 is disposed at the position on the opposite side of the fourth operating lever 5 from the control panel 4*a* (the rear side in FIG. 4, the upper side in FIG. 6).

Thus, the second actuator 73 does not project to a region where the control panel 4*a* is disposed. This enables the work machine 1 to prevent the second actuator 73 from obstructing an operation through the control panel 4*a*.

Further, as described above, in the work machine 1, the fourth actuator 81 is disposed rearward of the fifth operating lever 6.

Thus, the fourth actuator 81 does not project toward the getting-in/out passage 9. This enables the work machine 1 to prevent the fourth actuator 81 from obstructing an operator getting in and out.

Figure 7:
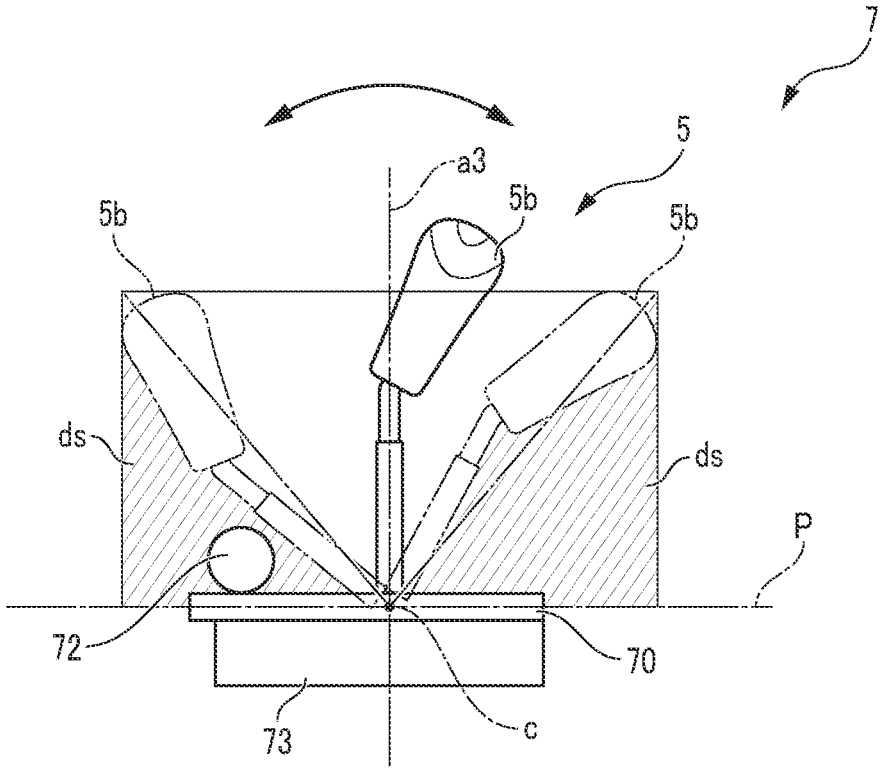
FIG. 7 is a side view illustrating the schematic configuration of the operating mechanism of the work machine of FIG. 1.

As illustrated in FIG. 7, in the first operating mechanism 7, a tilt pivot point c is a pivot point of the tilt of the fourth operating lever 5. Further, a third axis a3 (reference axis) is a line which is perpendicular to a straight line, the straight line connecting the tip of the fourth operating lever 5 (the tip of a tip portion 5*b*) tilted to the maximum extent to one side in the first direction and the tip of the fourth operating lever 5 tilted to the maximum extent to the other side in the first direction, and passes through the tilt pivot point c. Furthermore, the reference plane p is a plane which is perpendicular to the third axis a3 and passes through the tilt pivot point c.

The first actuator 72 is disposed above the reference plane p (that is, on the same side of the fourth operating lever 5 as the reference plane p, the front side) when viewed in the direction of the second axis a2 (refer to FIG. 6). On the other hand, the second actuator 73 is disposed below the reference plane p (that is, on the opposite side of the reference plane p from the fourth operating lever 5, the rear side).

In addition, as illustrated in FIG. 6, an end portion on the lower side of the first actuator 72 and a lower end portion of the second actuator 73 overlap each other when viewed in the direction of the third axis a3. Thus, the size of the first operating mechanism 7 on the reference plane p is smaller than that of a conventional operating mechanism.

Also in the second operating mechanism 8, the third actuator 80 and the fourth actuator 81 are disposed at least partially overlapping each other when viewed in the reference axis direction in the second operating mechanism 8.

Thus, the first operating mechanism 7 and the second operating mechanism 8 are smaller than a conventional operating mechanism.

This prevents the first actuator 72, the second actuator 73, the third actuator 80, and the fourth actuator 81 from projecting to regions such as the space on the slave-side seat 3 for an operator of the work machine 1 to sit in and the getting-in/out passage 9 even in a state where the first operating mechanism 7 and the second operating mechanism 8 are attached, which enables a sufficient space to be left in these regions.

Further, it is possible to improve flexibility in the layout of components of the work machine 1 including the first operating mechanism 7 and the second operating mechanism 8.

Furthermore, as illustrated in FIG. 7, the fourth operating lever 5 is tilted to operate the work machine 1. Thus, when viewed in the direction of the third axis a3, a space between the fourth operating lever 5 tilted to the maximum extent and the reference plane p (in a strict sense, the surface of the plate 70) is a dead space ds.

Thus, in the first operating mechanism 7, the first actuator 72 is disposed in the dead space ds to utilize the dead space ds. Specifically, the first actuator 72 and the tip portion 5*b* of the fourth operating lever 5 at least partially overlap each other when viewed in the direction of the third axis a3 with the fourth operating lever 5 tilted to the maximum extent. This further downsizes the first operating mechanism 7.

Note that, also in the second operating mechanism 8, the third actuator 80 corresponding to the first actuator 72 of the first operating mechanism 7 is disposed in a dead space of the fifth operating lever 6.

In the present embodiment, the first actuator 72 is disposed on the same side of the reference plane p as the fourth operating lever 5, whereas the second actuator 73 is disposed on the opposite side of the reference plane p from the fourth operating lever 5.

However, the first direction actuator and the second direction actuator of the present invention do not necessarily need to be disposed in this manner relative to the reference plane. For example, the first direction actuator and the second direction actuator may be disposed on one side of the reference plane.

Further, in the present embodiment, the first actuator 72 is disposed in the dead space ds. However, the first direction actuator of the present invention does not necessarily need to be disposed in the dead space. For example, the first direction actuator may be disposed outside the tip of the operating lever tilted to the maximum extent.

Although the illustrated embodiment has been described above, the present invention is not limited to such an embodiment.

For example, in the above embodiment, the control panel 4*a* is provided on the upper face of the slave-side console box 4 at the position rearward of the fourth operating lever 5. Along with this, in the first operating mechanism 7 attached to the slave-side console box 4, the second actuator 73 serving as the second direction actuator is disposed on the front side (the lower side in FIG. 6).

However, the operating mechanism of the present invention is not limited to such a configuration, and the second direction actuator may be provided at the position on the opposite side of the operating lever from the control panel. For example, in a case where the control panel is disposed forward of the operating lever in the console box, the second direction actuator may be disposed rearward of the operating lever.

A work machine of the present invention is a work machine operated on the basis of an operation command, the work machine comprising:

a seat for an operator to sit in;

an operating lever for controlling an operating amount of the work machine according to a tilt angle and a tilt direction, the operating lever being disposed beside the seat; and an operating mechanism configured to tilt the operating lever on the basis of the operation command, in which the operating mechanism includes a first direction guide member configured to tilt the operating lever in a first direction, and a first direction actuator configured to generate a driving force for tilting the operating lever through the first direction guide member on the basis of the operation command, and the first direction actuator is disposed at a position on the opposite side of the operating lever from the seat.

In this manner, in the work machine of the present invention, the first direction actuator is disposed at the position more distant from the seat than the operating lever is. Thus, according to the work machine of the present invention, the first direction actuator of the operating mechanism does not project toward the seat even in a state where the operating mechanism is attached to the operating lever, which makes it possible to leave a sufficient space on the seat for an operator to sit in.

Preferably, the work machine of the present invention further comprises a control panel disposed forward or rearward of the operating lever, in which the operating mechanism includes a second direction guide member configured to tilt the operating lever in a second direction intersecting the first direction, and a second direction actuator configured to generate a driving force for titling the operating lever through the second direction guide member on the basis of the operation command, and the second direction actuator is disposed at a position on the opposite side of the operating lever from the control panel.

To tilt the operating lever in a plurality of directions using the operating mechanism, a plurality of guide members which guide the operating lever in different directions and a plurality of actuators corresponding, one to one, to the guide members may be provided. In such a case, each of the actuators may be disposed at a position corresponding to the corresponding guide member at an orientation corresponding to a direction in which the corresponding guide member guides (tilts) the operating lever.

Thus, if the first direction actuator is disposed at the position on the opposite side of the operating lever from the seat, and the second direction actuator is disposed at an orientation corresponding to the second direction which intersects the first direction corresponding to the first direction actuator, the second direction actuator may project to a region where the control panel is disposed and obstruct an operation through the control panel.

Thus, when the second direction actuator is disposed at the position on the opposite side of the operating lever from the control panel as described above, the second direction actuator does not project to the region where the control panel is disposed. This makes it possible to prevent the second direction actuator of the operating mechanism from obstructing an operation through the control panel.

Preferably, the work machine of the present invention further comprises a getting-in/out passage extending at a front of the seat and the operating lever, in which the operating mechanism includes a third direction guide member configured to tilt the operating lever in a third direction intersecting the first direction, and a third direction actuator configured to generate a driving force for titling the operating lever through the third direction guide member on the basis of the operation command, and the third direction actuator is disposed rearward of the operating lever.

To tilt the operating lever in a plurality of directions using the operating mechanism, a plurality of guide members which guide the operating lever in different directions and a plurality of actuators corresponding, one to one, to the guide members may be provided. In such a case, each of the actuators may be disposed at a position corresponding to the corresponding guide member at an orientation corresponding to a direction in which the corresponding guide member guides (tilts) the operating lever.

Thus, if the first direction actuator is disposed at the position on the opposite side of the operating lever from the seat, and the third direction actuator is disposed at an orientation corresponding to the third direction which intersects the first direction corresponding to the first direction actuator, the third direction actuator may project toward the getting-in/out passage through which an operator passes when sitting in the seat (project forward) and obstruct the operator getting in and out of the seat.

Thus, when the third direction actuator is disposed rearward of the operating lever as described above, the third direction actuator does not project toward the getting-in/out passage. This makes it possible to prevent the third direction actuator of the operating mechanism from obstructing the operator getting in and out.

REFERENCE SIGNS LIST

1 work machine
2 remote operation apparatus
3 slave-side seat
4 slave-side console box
**4*a*** control panel
5 fourth operating lever
**5*a*** base end portion
**5*b*** tip portion
6 fifth operating lever
7 first operating mechanism (operating mechanism for work machine)
8 second operating mechanism (operating mechanism for work machine)
9 getting-in/out passage
10 boom
**10*a*** first hydraulic cylinder
11 arm
**11*a*** second hydraulic cylinder
12 attachment
**12*a*** third hydraulic cylinder
13 slewing structure
**13*a*** cab
**13*b*** machine room
14 undercarriage
15 slave-side operating device
16 operation driving device
17 operating state detector
18 external sensor
19 slave-side control device
**19*a*** operation control unit
**19*b*** peripheral object detection unit
**19*c*** slave-side communication unit
20 remote operation room
21 master-side seat
22 master-side console box
23 master-side operating device
**23*a*** operating pedal
**23*b*** first operating lever
**23*c*** third operating lever
24 speaker
25 display
26 operation state detector
27 master-side control device

27*a* output information control unit
27*b* master-side communication unit
70 plate
71 support member
72 first actuator (first direction actuator)
73 second actuator (second direction actuator)
74 first guide member (first direction guide member)
74*a* first turning portion
74*b* first guide portion
75 second guide member (second direction guide member)
75*a* second turning portion
75*b* second guide portion
76 first link mechanism
77 second link mechanism
80 third actuator (first direction actuator)
81 fourth actuator (third direction actuator)
82 third guide member (first direction guide member)
83 fourth guide member (third direction guide member)
S remote operation system
a1 first axis
a2 second axis
a3 third axis (reference axis)
c tilt pivot point
ds dead space
p reference plane

The invention claimed is:

1. A work machine operated based on an operation command, the work machine comprising:

a seat for an operator to sit in;

an operating lever for controlling an operating amount of the work machine according to a tilt angle and a tilt direction, the operating lever being disposed beside the seat;

an operating mechanism configured to tilt the operating lever based on the operation command;

a control panel disposed forward or reward of the operating lever; and a console box disposed beside the seat, wherein the operating lever and the control panel are disposed at the console box, the operating mechanism includes a second direction guide member configured to tilt the operating lever in a front-back direction, and a second direction actuator configured to generate a driving force for tilting the operating lever through the second direction guide member based on the operation command, and the second direction actuator is disposed at a position on an opposite side of the control panel side of the operating lever.

2. The work machine according to claim 1, comprising a control panel disposed forward or rearward of the operating lever, wherein the operating mechanism includes a first direction guide member configured to tilt the operating lever in a first direction intersecting the second direction, and a first direction actuator configured to generate driving force for titling the operating lever through the first direction guide member based on the operation command, and the first direction actuator is disposed at a position on an opposite side of the seat side of the operating lever.

3. The work machine according to claim 1, comprising a second link mechanism, wherein the second direction actuator has a rod-like shape extending in a left and right direction, and is configured to generate driving force rotating about an axis extending in the left and right direction based on the operation command, and the second link mechanism is configured to transmit the driving force generated by the second direction actuator to the second direction guide member.

4. The work machine according to claim 1, wherein the operating mechanism includes a first direction guide member configured to tilt the operating lever in a first direction which is a direction intersecting the front-back direction, and a first direction actuator configured to generate driving force for titling the operating lever through the first direction guide member based on the operation command, and the first direction actuator is disposed at a position on an opposite side of the seat side of the operating lever.

5. A work machine operated based on an operation command, the work machine comprising:

a seat for an operator to sit in;

an operating lever for controlling an operating amount of the work machine according to a tilt angle and a tilt direction, the operating lever being disposed beside the seat;

an operating mechanism configured to tilt the operating lever based on the operation command, and a getting-in and out passage extending at a front of the seat and the operating lever, wherein the operating mechanism includes a first direction guide member configured to tilt the operating lever in a first direction, and a first direction actuator configured to generate driving force for tilting the operating lever through the first direction guide member based on the operation command, a third direction guide member configured to tilt the operating lever in a third direction intersecting the first direction, and a third direction actuator configured to generate driving force for titling the operating lever through the third direction guide member based on the operation command, the first direction actuator is disposed at a position on an opposite side of the seat side of the operating lever, and the third direction actuator is disposed rearward of the operating lever.

* * * * *